US006079660A

United States Patent [19]

Manusch et al.

[11] Patent Number: 6,079,660

[45] Date of Patent: Jun. 27, 2000

[54] GEAR ARRANGEMENT FOR DRIVING THE SPOOL CORE OF A TAKE-UP SPOOL FOR THE TRANSFER TAPE OF A TRANSFER DISPENSER

[75] Inventors: Christoph Manusch, Hemmingen; Wulf Herrmannsen, Ronnenberg; Udo Obersteller, Langenhagen, all of Germany

[73] Assignee: Pritt Produktionsgesellschaft mbH, Hannover, Germany

[21] Appl. No.: 09/142,674

[22] PCT Filed: Mar. 3, 1997

[86] PCT No.: PCT/EP97/01052

§ 371 Date: Mar. 18, 1999

§ 102(e) Date: Mar. 18, 1999

[87] PCT Pub. No.: WO97/33824

PCT Pub. Date: Sep. 18, 1997

[30] Foreign Application Priority Data

Mar. 11, 1996 [DE] Germany ..... 196 09 533

[51] Int. Cl.[7] ..... B65H 18/08

[52] U.S. Cl. ..... 242/538.1; 242/538.3; 242/540; 242/546; 156/577

[58] Field of Search ..... 242/538.1, 538.3, 242/540, 546, 588, 345.1, 356.1; 156/577

[56] References Cited

U.S. PATENT DOCUMENTS

| | | | |
|---|---|---|---|
| 5,006,184 | 4/1991 | Manusch et al. | 156/577 |
| 5,430,904 | 7/1995 | Ono et al. | 156/577 |
| 5,480,510 | 1/1996 | Manusch et al. | 156/577 |
| 5,512,128 | 4/1996 | Manusch et al. | 156/577 |
| 5,657,937 | 8/1997 | Todd et al. | 242/345.1 |
| 5,679,156 | 10/1997 | Matsumaru | 118/200 |
| 5,942,036 | 8/1999 | You | 156/577 |

FOREIGN PATENT DOCUMENTS

| | | |
|---|---|---|
| 0 368 070 | 5/1990 | European Pat. Off. . |
| 0 427 870 | 5/1991 | European Pat. Off. . |
| 0 606 477 | 7/1994 | European Pat. Off. . |
| 0 631 959 | 1/1995 | European Pat. Off. . |
| 1 340 947 | 9/1963 | France . |
| 41 04 331 | 8/1992 | Germany . |
| 43 22 118 | 11/1994 | Germany . |
| 196 11 440 | 10/1996 | Germany . |
| 08 337 095 | 12/1996 | Japan . |

*Primary Examiner*—Donald P. Walsh
*Assistant Examiner*—Minh-Chau Pham
*Attorney, Agent, or Firm*—Wayne C. Jaeschke; Stephen D. Harper

[57] ABSTRACT

In a gear arrangement for driving the spool core (11) of a take-up spool for a transfer tape (5) through the spool core (3) of a feed spool arranged laterally of and radially offset from the take-up spool in the housing (2) of a transfer dispenser or in a refill cassette (1) for a transfer dispenser, comprising a first gearwheel (28) which is driven by the feed spool and which meshes with a second gearwheel (26,27) designed to drive the take-up spool (11), the pitch diameter of the second gearwheel (27) being smaller than that of the first gearwheel (28), a slipping clutch (16) being provided between the spool core (11) of one of the two spools and the associated gearwheel (27) and a radially projecting annular disc (13;14) being disposed on each spool core (3;11) and its side facing the other spool, the two spool cores (3,11) bear partly against one another through their mutually opposite annular discs (13,14). In addition, the first gearwheel (28) is formed with inner teeth (28) which are integral with the spool core (3) of the feed spool and in the interior of which lies the second gearwheel (27), the take-up spool being mounted for rotation on a spindle (15) integral with the housing or the cassette through a central annular sleeve (25). The annular sleeve (25) has a lateral extension (26) which carries the second, externally toothed gearwheel (27) meshing with the first gearwheel (28).

20 Claims, 2 Drawing Sheets

GEAR ARRANGEMENT FOR DRIVING THE SPOOL CORE OF A TAKE-UP SPOOL FOR THE TRANSFER TAPE OF A TRANSFER DISPENSER

BACKGROUND OF THE INVENTION

This invention relates to a gear arrangement for driving the spool core of a take-up spool for a transfer tape through the spool core of a feed spool arranged laterally of and radially offset from the take-up spool in the housing of a transfer dispenser or in a refill cassette for a transfer dispenser, comprising a first gearwheel which is driven by the feed spool and which meshes with a second gearwheel designed to drive the take-up spool, the pitch diameter of the second gearwheel being smaller than that of the first gearwheel, a slipping clutch being provided between the spool core of one of the two spools and the associated gearwheel and a radially projecting annular disc being disposed on each spool core and its side facing the other spool.

Transfer dispensers are widely used in offices and homes. They are hand-held devices for transferring a film, for example an adhesive film or a cover-up film, from a carrier tape to a substrate, the film-coated carrier tape being wound onto a feed spool in the dispenser housing and being guided from the feed spool to an applicator foot projecting from the housing. By means of the applicator foot, the film-coated carrier tape can be pressed onto a substrate, the film layer being separated from the carrier tape and transferred to the substrate in conjunction with the reversal of the tape at the applicator foot. The empty carrier tape is then reversed at the applicator foot and returned to a take-up spool in the dispenser housing. The feed spool and the take-up spool and also the applicator foot are often accommodated together in a cassette.

The feed spool is made to rotate by the removal of the carrier tape from the feed spool when the dispenser is in use, i.e. during its movement over the substrate. The feed spool drives the take-up spool through a suitable intermediate gear and the slipping clutch, the design of the gear having to take into account the fact that the carrier tape must always be kept under a certain tension irrespective of the offwinding diameter of the carrier tape on the feed spool and the winding-on diameter of the carrier tape on the take-up spool.

In known transfer dispensers, the take-up spool and the feed spool can be arranged in tandem in the same plane although this does lead to relatively large dispensers. Instead of this, however, the two spools may also be arranged beside one another, both coaxial and axially slightly offset spool arrangements being known. In this way, the dispenser housing can be made considerably shorter in its longitudinal direction than in the case of spools arranged in tandem in one plane, the housing having to be made slightly thicker solely in the vicinity of the spool mounting as a result of the juxtaposition of the spools. This particular solution is adopted above all when the dispenser housing is intended to be in the form of an "elongate" housing where part of the housing is relatively small in cross-section and elongated, for example in the form of an elongate cylinder or the like, which enables the housing to be held there like a relatively thick pencil or fountain pen. The larger and slightly thicker part of the housing is arranged at the end of this elongate part to accommodate the two spools, being situated above the back of the user's hand when the dispenser is in use (similarly to the cap of a fountain pen during writing), i.e. in a position where there is no interference with the convenient holding of the dispenser in the hand of the user at the elongate, thinner part of the housing.

A particular concern in the design of these "elongate" transfer dispensers is also to configure the larger part of the housing at the end of the elongate dispenser in such a way that its width (i.e. the space it occupies axially of the spools) is as small as possible so that the dispenser as a whole is small and handy.

In one known transfer dispenser of the type mentioned at the beginning marketed under the name of "Tombo" where the two spools are arranged in a refill cassette, the refill cassette has a longitudinally extending intermediate wall section on one side of which the feed spool and on the other side of which the take-up spool are mounted for rotation. The spool core of the feed spool is disposed on a rotary mounting which in turn is mounted for rotation on a spindle integral with the cassette and projecting from the intermediate wall section thereof. The spool core of the feed spool is held on the rotary mounting by friction so that a slipping clutch operating by friction is formed between the two. The rotary mounting in turn is provided with a radially projecting annular disc which projects radially at the axial end of the spool core of the feed spool that faces the intermediate wall section of the cassette so that the tape is prevented from slipping sideways off its roll towards the intermediate wall section when the transfer dispenser is in use. Formed integrally with the rotary mounting between the annular disc and the intermediate wall section is a gearwheel which meshes with a second smaller gearwheel of which the central axis is offset from the central axis of the rotary mounting longitudinally of the transfer dispenser and which, in turn, comprises an integral lateral shaft section through which it is rotatably mounted in the intermediate wall section of the cassette. This lateral shaft section projects through the intermediate wall of the cassette to the other side thereof where the spool core of the take-up spool is mounted for rotation thereon.

In addition, radially projecting side discs are fitted from outside onto the central spindles of the feed and take-up spools at their free axial ends to prevent the carrier tape from slipping sideways off its roll on this side, too, when the transfer dispenser is in use.

In view of the gear arrangement of the refill cassette of this known transfer dispenser, the space occupied transversely of the cassette, i.e. axially of the spools, is comparatively large because not only do the spool widths have to be accommodated here, allowance also has to be made for the width of the outer cover discs on both spools, the thickness of the two annular discs, the thickness of the intermediate wall section and the thickness of the two gearwheels on the side of the feed spool. In addition, a comparatively large number of parts is involved in the construction of the described gear arrangement of this known transfer dispenser.

SUMMARY OF THE INVENTION

Against this background, the problem addressed by the present invention was to provide a gear arrangement of the type mentioned at the beginning for juxtaposed spools which would be narrower than the known arrangement and which would have a simple construction involving even fewer parts.

According to the invention, the solution to this problem for a gear arrangement of the type mentioned at the beginning is characterized in that the two spool cores bear partly against one another through their mutually opposite annular discs; in that, in addition, the first gearwheel is formed by inner teeth on the spool core of the feed spool in the interior of which the second gearwheel is disposed; in that the take-up spool is mounted for rotation on a spindle integral with the housing or cassette through a central annular sleeve and in that the annular sleeve is provided with a lateral shoulder which carries the second externally toothed gearwheel meshing with the first gearwheel.

According to the invention, the space occupied by the width of the transfer dispenser or the refill cassette is distinctly smaller than in the known transfer dispenser because only the width of the two spools and their annular discs has to be covered. The two spools or spool cores, which bear against one another through their annular discs (and thus axially support one another), are mounted on the spindle which is integral with the cassette or the housing and which projects from a side wall of the housing or the refill cassette. The transfer dispenser does not occupy any more space over its width (axially of the spools).

In addition, the gear arrangement according to the invention has a remarkably small number of parts which have to be fitted into or onto one another, namely two spool cores, which are provided (for example integrally) with the radially projecting annular discs; the slipping clutch (which is formed in one piece with the lateral shoulder of its annular sleeve and the teeth of the second gearwheel) and, finally, the spindle—integral with the housing or the cassette—with the associated side wall section of the cassette or the housing. The distinctly reduced number of necessary parts compared with the known arrangement simplifies the overall construction and considerably accelerates and simplifies assembly as a whole.

By virtue of the fact that, according to the invention, the spool cores of the two spools bear partly against one another through their radially projecting annular discs, the two spool cores can be axially fixed relative to one another without any need to use an intermediate wall so that, when one spool core is suitably supported at its other axial end by a side wall of the housing or the refill cassette, the free end of the central annular sleeve which is joined to the other spool need only be axially fixed on the spindle to fix the arrangement as a whole firmly in the housing or the cassette. In addition, by using a toothed-wheel gear assembly, it is possible according to the invention through the presence of inner teeth to arrange the two toothed wheels in the plane of the feed spool (i.e. in the inner space surrounded by its spool core) so that no additional space is needed to accommodate the toothed wheel gear assembly. Another advantage of the invention is that the interengaging teeth are not subjected to any load in the direction of force.

According to the invention, the take-up spool, for example, can be made entirely in one piece with the central annular sleeve and its lateral shaft extension provided with teeth to form the second gearwheel. In this case, the slipping clutch has to be suitably arranged between the spool core of the feed spool and the inner teeth, for example using an appropriate friction fit between the spool core and a rotary mounting formed with the inner teeth. In one particularly preferred embodiment of the invention, however, the slipping clutch is arranged between the spool core of the take-up spool and the spindle and surrounds the central annular sleeve. The slipping clutch may assume any suitable form. In a particularly preferred embodiment, however, the slipping clutch comprises several spring tongues radiating from the central annular sleeve which bear under bias against, and support, the internal diameter of the spool core of the take-up spool, i.e. form a rotary mounting for this spool core. In this way, an even longer useful life can be achieved for the slipping clutch than in the case where the slipping clutch consists solely of a purely friction fit of the spool core on a corresponding rotary mounting, as for example in the known gear arrangement, so that even the slightest signs of friction-induced wear lead immediately to significant influencing of the friction moment and hence to a change in the properties of the friction clutch.

The inner toothing can be provided in any suitable form on the spool core of the feed spool. In a particularly preferred embodiment, however, the inner toothing is integrally formed on the inner circumference of the spool core of the feed spool so that the teeth and the spool core consist of a single part which is preferably made of plastic, for example by injection moulding.

In one advantageous embodiment of the invention, the external diameters of the annular discs of both spool cores are the same. In this way, the space predetermined by the external diameter of the feed spool roll—in turn governed by the required yardage of tape—can also be fully utilized on the take-up side, the core of the take-up spool being designed in such a way that the external diameter of the full used-tape roll corresponds to that of the full feed roll which advantageously provides for a low roll height (number of layers of the used-tape roll).

In another advantageous embodiment of the invention, the spool core of the feed spool is axially supported at its axial end face remote from the annular disc by the side wall of the housing or a side wall of the refill cassette and, around its inner circumference, is supported firmly in the housing or cassette by one or more support points which is/are offset from the point of engagement of the inner teeth with the second gearwheel. This is preferably achieved by an arrangement in which the spool core of the feed spool is supported radially of its axis of rotation at a point radially opposite the point of engagement of its inner teeth with the second gearwheel by a support element fixed to the side wall of the housing or the cassette, so that two points of support facing one another through about 180° are established, namely first the support element itself and second the point of engagement between the inner teeth and the second gearwheel. In this way, the spool core of the feed spool is also radially fixed as a whole. In a particularly preferred embodiment, the support element is in the form of an arcuate support element which is fixed to the side wall of the housing or the cassette and extends over a certain angle and which may assume the form of a small arcuate stop projecting slightly from said side wall. This arcuate stop bears through its radially outer surface against a corresponding annular shoulder on the inside of the spool core of the feed spool and radially supports the spool core while fully maintaining its ability to move in the direction of rotation. Preferably, the arcuate support element radially supports the spool core of the feed spool over an angle of about 180°. Instead of a single full-length arcuate support element, however, several, for example two or three or even more, support elements may also be provided, their support surfaces all being arranged on a corresponding arc which corresponds to the internal diameter of a corresponding annular shoulder on the feed spool.

In another particularly preferred embodiment, the support element is integrally formed with a side wall of the housing or the cassette so that a onepiece component is again formed. If desired, the arcuate support element may of course also be made as a separate part and suitably fixed to the side wall of the housing or the cassette, for example by an adhesive or the like.

If the slipping clutch of the gear arrangement according to the invention is provided with several spring arms radiating from the central annular sleeve, it is of particular advantage if, in addition to the spring arms, radial support flanges are also provided for additionally supporting the internal diameter of the take-up spool in such a way that they merge with the spring arms at their radially inner ends. The radial support flanges are provided at their free ends with support shoes which are each provided on their surface with a bearing face adapted in shape to the inner surface of the spool core of the take-up spool. In one particularly advantageous embodiment, the support shoes are provided over their axial width, i.e. their width axially of the take-up spool, with a taper that slopes radially towards the second gearwheel to enable the slipping clutch—in which the spring arms are integrally formed as a single part with the central annular sleeve and its lateral extension with the outer teeth—to be inserted particularly easily and quickly from the outside of the spool core of the take-up spool into the internal diameter thereof. This is because a slight conicity is thus created in the insertion direction which considerably simplifies assembly.

In another advantageous embodiment of the invention, stops projecting radially beyond the support surface are arranged on the support shoes at the axial ends thereof which lie on the side remote from the second gearwheel, said stops bearing axially against an annular shoulder correspondingly provided on the inner circumference of the spool core of the take-up spool and axially fixing this spool core and hence the take-up spool relative to the central annular sleeve.

In another particularly preferred embodiment of the invention, the spindle is designed over at least part of its circumference in such a way that it comprises an elastic tongue which terminates axially at the free axial end of the spindle and which can be formed, for example, by two slots which lie parallel to one another and to the central axis of the spindle and which extend axially a certain distance into the spindle from the free end thereof, this elastic tongue being provided at its free end with a radially projecting stop which, in the assembled state, bears axially against the radial end face of the annular sleeve and fixes both spools for rotation relative to the side wall of the housing or the cassette.

The invention provides a surprisingly simple and very compact gear arrangement which occupies very little space in the direction of the width of the housing or the refill cassette. In addition, the arrangement according to the invention consists of particularly few parts which can be assembled quickly and easily, are simple to make and thus enable the refill cassette or the transfer dispenser as a whole to be manufactured particularly inexpensively.

THE DRAWINGS

The invention is described by way of example in the following with reference to the accompanying drawings, wherein.

DETAILED DESCRIPTION

Figure 1:
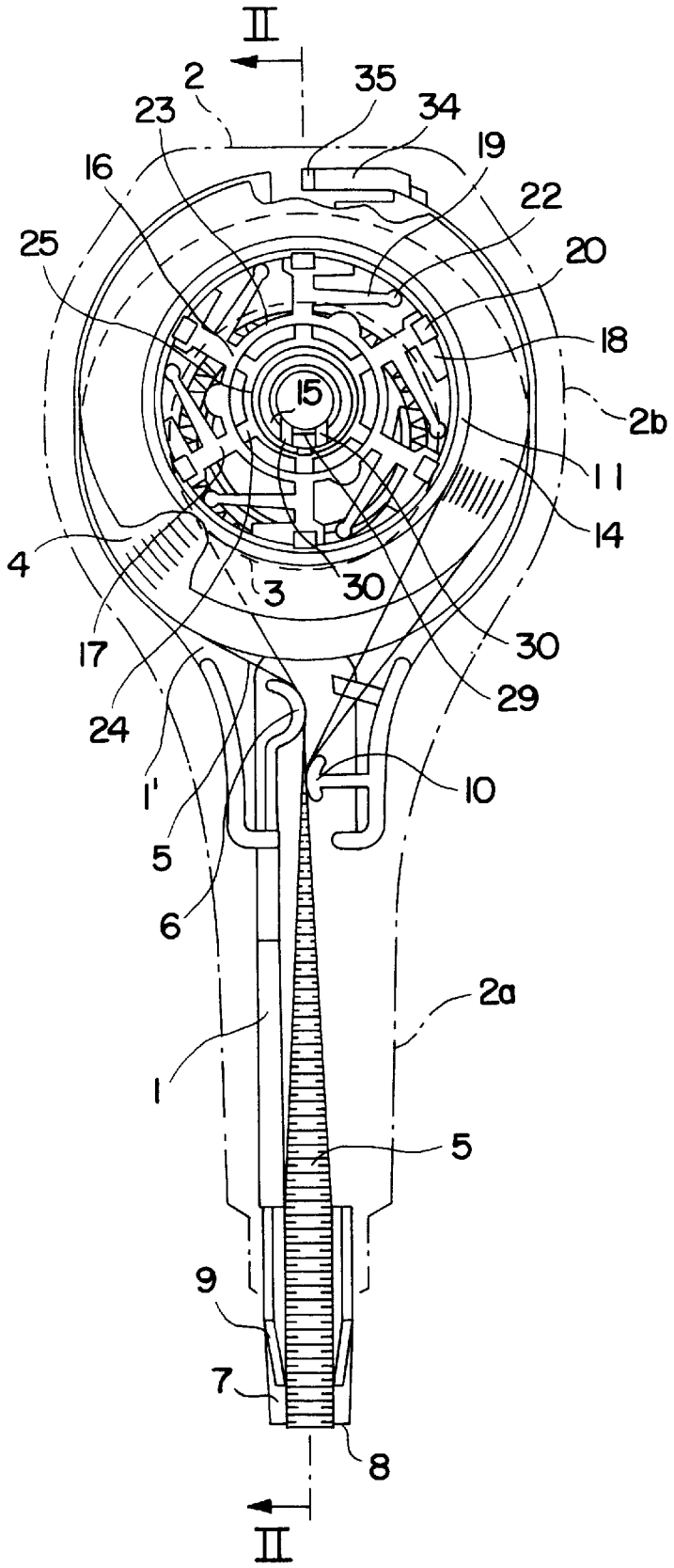
FIG. 1 is a side elevation of a refill cassette comprising a gear arrangement according to the invention loaded into a housing—shown only schematically—of a transfer dispenser.
Figure 2:
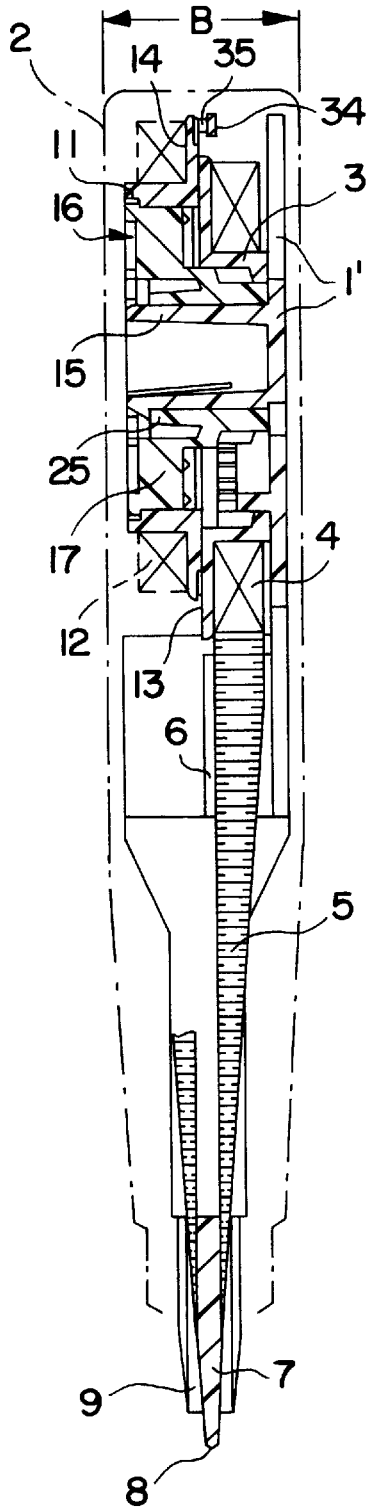
FIG. 2 is a section on the line II—II of FIG. 1.

FIG. 1 is a side elevation of a refill cassette 1 loaded into a housing 2—shown only in dash-dot lines—of a transfer dispenser. FIG. 2 is a section on the line II—II of FIG. 1.

The refill cassette 1 has a supporting structure which includes a side wall 1'. In the loaded position of the refill cassette 1, the side wall 1' is immediately adjacent a side wall of the housing 2. If the transfer dispenser were of the type which did not take refill cassettes, the side wall 1' of the refill cassette 1 shown in FIGS. 1 and 2 could be formed by the side wall of the housing 2. However, the following embodiments relate to the case illustrated in FIGS. 1 and 2 where a refill cassette is used although the expert will have no difficulty in immediately realizing that the constructive arrangements to be described in the following could equally well be used in a transfer dispenser with no refill cassettes.

As can be seen from FIGS. 1 and 2, the refill cassette comprises a take-up spool formed by a spool core 3 onto which a roll 4 of film-coated carrier tape 5 is wound. The carrier tape 5 travels from the supply roll 4 of the carrier spool to a guide element 6 in the form of a spring arm against which the tape bears under its own tension and which has an equalizing effect in the event of variations in that tension and acts as a guide element to ensure that the tape runs correctly into the elongate section 2*a*—smaller in cross-section—of the housing 2 of the transfer dispenser. As shown in FIGS. 1 and 2, this elongate section 2*a* of the housing is designed in such a way that it can easily be gripped by the user in the fingers so that the dispenser as a whole can be held like a fountain pen or the like. This elongate section 2*a* of the housing continues into a wider section 2*b* where the spools and the slipping clutch are accommodated. Although the section 2*b* of the housing is only slightly wider than the section 2*a* (width B in FIG. 2), FIG. 1 shows it to be much broader (perpendicularly of the central axis of the spool core 3).

After entering the elongate section 2*a* of the housing, the film-coated carrier tape 5 is guided to an applicator foot 7 which is arranged at the lower end of the refill cassette, projecting outwards from the elongate section 2*a* of the housing at the free end thereof, but of which the width is turned through 90° to the plane of the carrier tape 5 at its point of entry at the guide element 6. Accordingly, the film-coated carrier tape 5 is also turned continuously through 90° between the guide element 6 and the press-on edge 8 of the applicator foot 7 so that its plane lies parallel to the press-on edge 8 of the applicator foot 7. The carrier tape 5 is guided by lateral projections 9 on the applicator foot 7, passes around the press-on edge 8 and then returns (cf. FIG. 2) via the elongate section 2*a* of the housing 2 on the other side of the applicator foot 7 to a second reversal point 10 and, at the same time, is again turned through 90°.

To use the dispenser, the film-coated carrier tape 5 is pressed onto a suitable substrate (for example of paper or the like) by the press-on edge 8 of the applicator foot 7. The film (for example an adhesive film or a cover-up film) is transferred from the carrier tape 5 to the substrate while the carrier tape 5 freed from the film is returned to a take-up spool after reversal at the press-on edge 8 via the guide element 10. The take-up spool consists of a spool core 11 onto which the carrier tape is wound in the form of a roll 12. FIGS. 1 and 2 show the phases in which the supply roll 4 is still completely present on the take-up spool whereas there is still no supply of tape present on the spool core 11 of the take-up spool (which, purely for information, is shown in chain lines in FIG. 2 for the case of a full take-up spool). In FIG. 1, the external diameter of the spool core 3 of the feed spool is shown only as a chain line to illustrate a relative association of the positions of the spool cores 3 and 11.

As can be seen from FIG. 1, the central axes of the spool cores 3 and 11 are offset axially to one another (i.e. longitudinally of the housing 2).

It can also be seen from FIGS. 1 and 2 that, at their axial ends facing one another, the spool cores 3 and 11 are each provided with a radially projecting flanged disc. These flanged discs are formed by annular discs 13 and 14. The spool core 3 of the feed spool carries the annular or flanged disc 13 while the spool core 11 carries the annular or flanged disc 14, as can best be seen from FIG. 3 which is a section on an enlarged scale through the gear arrangement shown in FIG. 2. The annular discs 13 and 14 bear against one another on their mutually opposite sides so that they support one another in the axial direction. However, since the adjacent spool cores 3 and 11 are slightly offset axially to one another, the radial annular discs 13 and 14 are not in contact with one another over their entire mutually opposite radial annular surfaces, but only ever cover one another partly according to their radial relative position, as shown particularly clearly in FIG. 3. However, the mutual encircling contact surface is large enough to guarantee the necessary axial support.

Projecting from, and formed integrally with, the side wall 1' of the refill cassette 1 is a spindle 15 (FIG. 3) on which the entire gear arrangement is mounted, as described in more detail in the following.

The spool core 11 of the take-up spool is mounted on the spindle 15 via a slipping clutch globally denoted by the reference numeral 16. The slipping clutch 16 comprises radial support flanges 17 arranged in the shape of a star which are provided at their radial ends with support shoes 18, the spool core 11 of the take-up spool being supported around its radial inner circumference by the outer peripheral surface of the support shoes 18. As shown by FIG. 2 and, above all, FIG. 3, stops 20 are provided at the axial end of the support shoes 18, projecting slightly beyond the outer peripheral surface thereof in the radial direction. The radially projecting inner surfaces of the stops 20 bear axially against a corresponding annular shoulder 21 provided on the inner periphery of the spool core 11 of the take-up spool and thus fix the spool core 11 in relation to the spool core 3 (and—via the spool core 3—in relation to the side wall 1' of the refill cassette 1).

As shown by the illustration in FIG. 1, which should be specifically referred to in this regard, spring arms 19 project from the support flanges 17 and, at their radial ends, carry circular end beads 22 with which they bear against the inner periphery of the spool core 11 under a certain elastic bias.

The support flanges 17 with their support shoes 18 and the spring arms 19 with the end beads 22 together form a rotational mounting on which the spool core 11 of the take-up spool is radially supported and which, at the same time, serves as a slipping clutch.

At their radially inner ends, the support flanges 17 are joined together by an annular section 23 which in turn is joined by connecting ribs 24 to a central annular sleeve 25. As shown in particular in FIG. 3, the annular sleeve 25 has a lateral shaft extension 26 which projects into the interior of the spool core 3 and which is externally provided with teeth 27, as shown particularly clearly in FIG. 4 which is a section through the central plane IV—IV of the feed spool (cf. FIG. 3).

Figure 4:
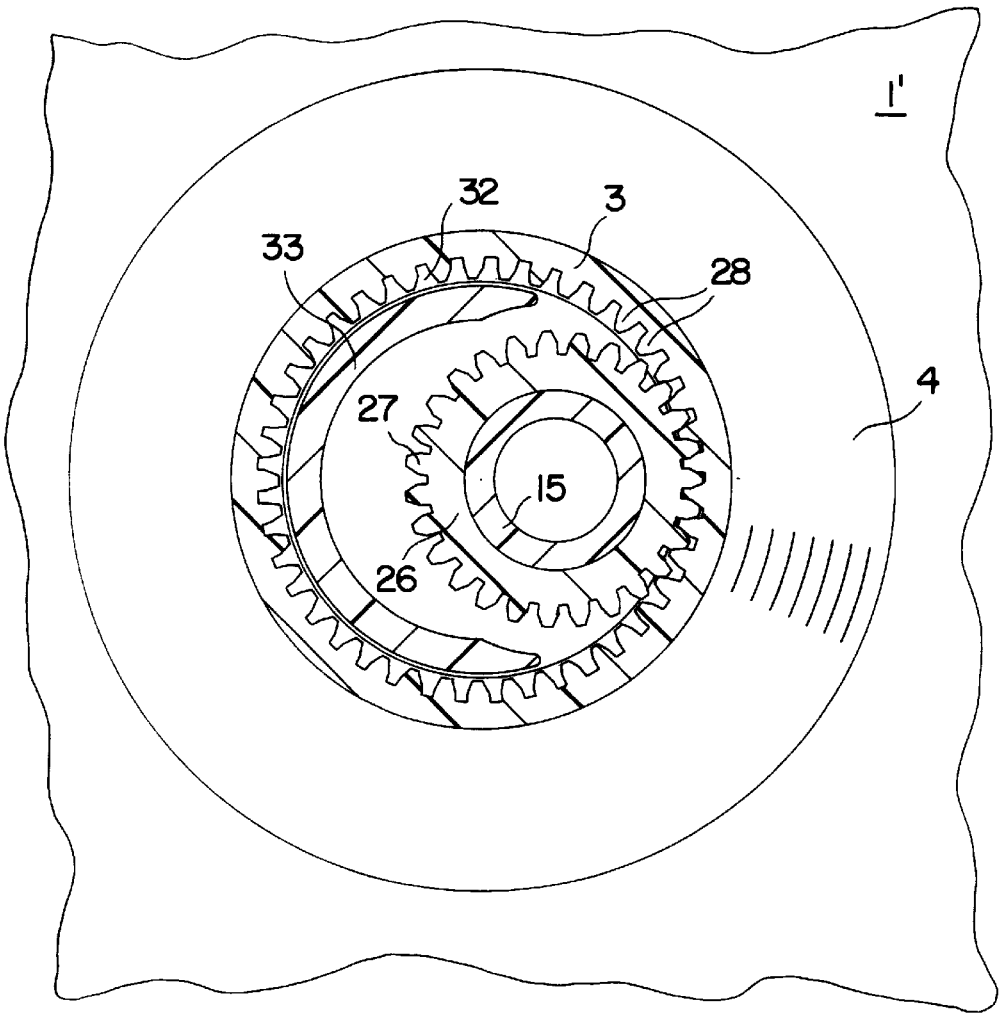
FIG. 4 is a section (on an enlarged scale) through the mounting of the feed spool and the interengagement of the inner teeth with the gearwheel driving the take-up spool.

The spool core 3 of the feed spool in turn is provided on its internal diameter with inner teeth 28 and thus forms a first internally toothed gearwheel which meshes with the second gearwheel formed from the shaft extension 26 and the outer teeth 27, as can be seen particularly clearly from FIG. 4.

Figure 3:
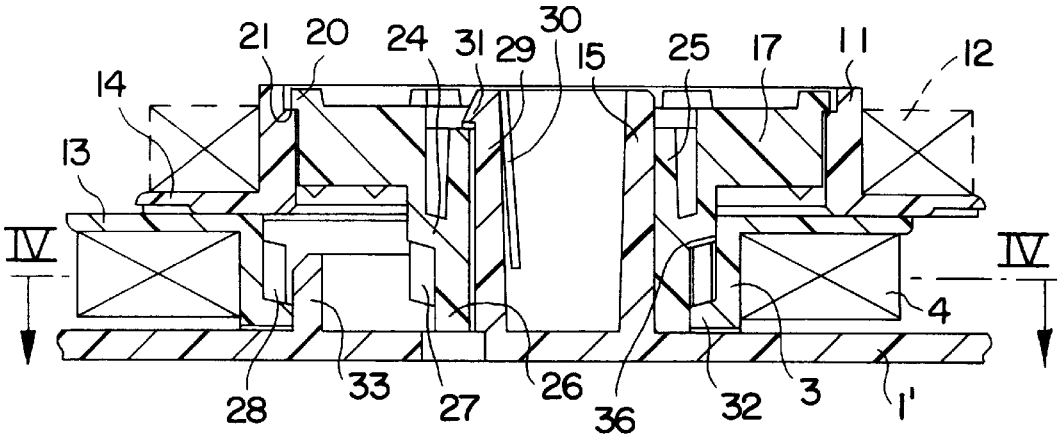
FIG. 3 is a section on an enlarged scale through part of the gear arrangement shown in FIG. 1.

The slipping clutch consisting of the support flanges 17, the support shoes 18, the spring arms 19 with their end beads 22, the connecting section 23, the connecting ribs 24, the annular sleeve 25 and its lateral shaft extension 26 with the outer teeth 27 is made in one piece of plastic. The radial support surfaces of the support shoes 18 may be in the form of cylinder sections, as shown in FIGS. 2 and 3. Alternatively, they may be provided with a slight taper towards the side wall 1' of the refill cassette 1 to facilitate introduction during the assembly process. However, this taper should only be very slight to ensure good radial outer contact with the inner periphery of the spool core 11 of the take-up spool in the assembled state.

As can be seen from FIG. 3, an axially extending spring tongue 29 is provided on the circumference of the spindle 15. It is formed by two axial indentations 30 in the body of the spindle 15 which do not quite extend over its axial length starting from the free end of the spindle 15. At its axial end, the spring tongue 29 is provided with a radially projecting stop 31 which axially retains the radial end face of the annular sleeve 25 and prevents it from slipping off the spindle 15.

At its axial end facing the side wall 1' of the refill cassette 1, the spool core 3 of the feed spool is provided with an annular shoulder 32 which projects radially inwards and by which it is supported on the one hand on the outer periphery of the terminal section of the shaft extension 26 of the annular sleeve 25 in the angular region where the inner teeth 28 of the spool core 3 interengage with the outer teeth 27 of the shaft extension 26. In addition, the flanged disc 13 is supported at its inner diameter by the outer circumference 36 of a step in the shaft extension 26, as clearly shown in FIG. 3 (right-hand half). In this way, a support between the spool core 3 and the shaft extension 26 is created on both sides of the flanks of the interengaging teeth of the outer toothing 27 of the shaft extension 26 and the inner toothing 28 of the spool core 3 of the feed spool so that almost ideal meshing can be achieved between the gear rings of the outer toothing 27 and the inner toothing 28.

On the radially opposite side, the spool core 3 of the feed spool is supported by the radial inner surface of an annular shoulder 32 on an arcuate support element 33 which projects in one piece from the side wall 1' of the refill cassette 1. The support element 33 extends peripherally over an angle of slightly more than 180° and supports the spool core 3 radially relative to the spindle 15. Overall, the spool core is adequately supported for rotation by the support element 33 and the interengagement of the inner teeth 28 with the outer teeth 27 of the shaft extension 26 which in turn is supported for rotation by the spindle 15 integral with the housing. The fact that, as shown in FIG. 3, the spool core 3 of the feed spool and the slipping clutch 16 support one another (through the shaft extension 26 and the outer diameter of the connecting ribs 24) ensures that the two interengaging gear rings 27 and 28 are always in an ideal position relative to one another.

The illustrated gear arrangement is put together as follows:

First, the spool core 3 is fitted axially onto the support element 33 and, with the radial inner peripheral surface of its annular shoulder 32, is pressed against the outer peripheral surface of the support element 33 and thus aligned. The slipping clutch 16 is then axially introduced into the radial interior of the spool core 11 of the take-up spool until the stops 20 come into contact with the associated annular shoulder 21 of the spool core 11. The shaft extension 26 of the central annular sleeve 25 is then pushed axially onto the spindle 15 until the outer teeth 27 on the shaft extension 26 mesh with the inner teeth 28 on the spool core 3 of the take-up spool and the radial retaining stop 31 of the spring tongue 29 axially fixes the central annular sleeve 25. In this position, the two opposite side faces of the annular discs 13 and 14 also align with one another. This completes the assembly of the entire gear arrangement which can only take place from one direction.

The gear arrangement has only a few parts which are normally made of suitable plastics: the spool core 11 for the take-up spool with the integrally formed annular disc 14, the totally integral slipping clutch 16 (with the support flanges 17, the support shoes 18, the spring arms 19, the central annular sleeve 25, the shaft extension 26 and the outer teeth 27) and, as a third component, the spool core 3 of the take-up spool with its annular shoulder 32 and its annular disc 13. As illustrated, these parts need only be fitted axially into or onto one another in a total of only three axial fitting steps.

The refill cassette is additionally provided with a spring tongue 34 equipped at its free end with a stop pin 35 (FIGS. 1 and 2) which, in turn, engages with teeth formed at the radially outer end of the annular disc 14 of the take-up spool and which is designed to function as a non-return element so that only a winding-on movement is possible and not an offwinding movement. The slightly offset arrangement of the spools relative to one another thus provides for a particularly space-saving arrangement of a non-return element.

In the illustrated embodiment, the outer diameter of the spool core of the take-up spool is larger than the outer diameter of the spool core 3 of the feed spool.

When, in the practical application of the transfer dispenser, the carrier tape 5 is being offwound from the supply roll, the spool core 3 is made to rotate. Its inner teeth 28 drive the outer teeth 27 of the gearwheel 26. Since the pitch diameter of the outer teeth 27 is automatically smaller than that of the inner teeth 28, one revolution of the spool core 3 during offwinding produces more than one revolution of the gearwheel 26 and hence more than one revolution of the central annular sleeve 25 and—via the slipping clutch 16 of the spool core 11—the take-up spool. This ensures that, even when the roll 4 on the feed spool is full, the winding-on distance on the spool core 11 is greater from the outset than the length of the offwound carrier tape 5 so that the carrier tape 5 is immediately placed under tension. When the required tape tension, i.e. the build-up of a corresponding braking moment on the spool core 11 of the take-up spool, is reached, the slipping clutch 16 begins to slip. However, this always ensures that, even when the roll 4 on the feed spool is full, the required tape tension is built up and loop-free winding onto the take-up spool is guaranteed. As the offwinding diameter of the roll 4 on the feed spool decreases and the diameter of the roll 12 of tape on the take-up spool increases, the difference in speed between the two spool cores becomes more pronounced so that the slipping clutch 16 has to accommodate correspondingly greater slip.

What is claimed is:

1. A gear arrangement for driving the spool core of a take-up spool for a transfer tape through the spool core of a feed spool arranged laterally of and radially offset from the take-up spool in a selective one of the housing of a transfer dispenser and in a refill cassette for a transfer dispenser, comprising a first gearwheel which is driven by the feed spool and which meshes with a second gearwheel designed to drive the take-up spool, the pitch diameter of the second gearwheel being smaller than that of the first gearwheel, a slipping clutch being provided between the spool core of one of the two spools and the associated gearwheel and a radially projecting annular disc being disposed on each spool core and its side facing the other spool, wherein the two spool cores bear partly against one another through their mutually opposite annular discs; the first gearwheel is formed by inner teeth on the spool core of the feed spool in the interior of which the second gearwheel is disposed; the take-up spool is mounted for rotation on a spindle; integral with the selective one of the housing and cassette through a central annular sleeve and the annular sleeve is provided with a lateral extension which carries the second, externally toothed gearwheel meshing with the first gearwheel.

2. A gear arrangement as claimed in claim 1, wherein the slipping clutch is arranged between the spool core of the take-up spool and the spindle and surrounds the central annular sleeve.

3. A gear arrangement as claimed in claim 2, wherein the inner teeth are integrally formed on the inner circumference of the spool core of the feed spool.

4. A gear arrangement as claimed in claim 3 wherein the diameter of the spool core of the take-up spool is at least as large as that of the spool core of the feed spool.

5. A gear arrangement as claimed in claim 2, wherein the slipping clutch comprises several spring arms which radiate from the central annular sleeve and which bear under bias against the internal diameter of the spool core of the take-up spool and support the spool core.

6. A gear arrangement as claimed in claim 5, wherein in addition to the spring arms, the slipping clutch also comprises radial support flanges for supporting the internal diameter of the take-up spool with which the spring arms merge at their radially inner ends.

7. A gear arrangement as claimed in claim 6, wherein the radial support flanges are provided at their free ends with support shoes which are provided on their surface with a bearing face adapted to the inner face of the spool core of the take-up spool.

8. A gear arrangement as claimed in claim 7, wherein stops projecting radially beyond the support shoes are arranged on the support shoes at the axial ends thereof which lie on the sides remote from the second gearwheel, said stops bearing axially against an annular shoulder correspondingly provided on the inner circumference of the spool core of the take-up spool.

9. A gear arrangement as claimed in claim 8, wherein the slipping clutch, its lateral extension and the second gearwheel are made in one piece of plastic.

10. A gear arrangement as claimed in claim 5 wherein the spool core of the feed spool is axially supported at its axial end face remote from the annular disc by the selective one of the housing or the cassette and, around its inner circumference, is supported firmly in the selective one of the housing and cassette by one or more support points which is/are offset from the point of engagement of the inner teeth with the second gearwheel.

11. A gear arrangement as claimed in claim 1, wherein the diameter of the spool core of the take-up spool is at least as large as that of the spool core of the feed spool.

12. A gear arrangement as claimed in claim 11, wherein the external diameters of the annular discs of the two spool cores are the same.

13. A gear arrangement as claimed in claim 12 wherein the slipping clutch comprises several spring arms which radiate from the central annular sleeve and which bear under bias against the internal diameter of the spool core of the take-up spool and support the spool core.

14. A gear arrangement as claimed in claim 1, wherein the spool core of the feed spool is axially supported at its axial end face remote from the annular disc by the selective one of the housing or the cassette and, around its inner circumference, is supported firmly in the selective one of the housing and cassette by one or more support points which is/are offset from the point of engagement of the inner teeth with the second gearwheel.

15. A gear arrangement as claimed in claim 14, wherein the spool core of the feed spool is supported radially of its axis of rotation at a point radially opposite the point of engagement of its inner teeth with the second gearwheel by a support element fixed to the housing or the cassette.

16. A gear arrangement as claimed in claim 15, wherein the support element is in the form of an arcuate support element which is fixed to the housing or the cassette and extends over a certain angle.

17. A gear arrangement as claimed in claim 16, wherein the arcuate support element radially supports the spool core of the feed spool over an angle of about 180 degrees.

18. A gear arrangement as claimed in claim 17 wherein the support element is integrally formed with a side wall of the selective one of the housing and the cassette.

19. A gear arrangement as claimed in claim 15, wherein the support element is integrally formed with a side wall of the selective one of the housing and the cassette.

20. A gear arrangement as claimed in claim 1, wherein the spindle integral with the selective one of the housing and the cassette is designed over at least part of its circumference as a tongue which extends axially to the free axial end of the spindle and which is provided at its free end with a radially projecting stop which, in the assembled state, bears axially against the radial end face of the annular sleeve and fixes both spools for rotation relative to the selective one of the housing and the cassette.

* * * * *